US006394645B1

(12) United States Patent
Suzuki et al.

(10) Patent No.: US 6,394,645 B1
(45) Date of Patent: May 28, 2002

(54) ELECTRONIC WATCH WITH CORRECTING MECHANISM

(75) Inventors: Shigeo Suzuki; Mamoru Watanabe; Kenichi Nakajima, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/638,215

(22) Filed: Aug. 11, 2000

(30) Foreign Application Priority Data

Sep. 6, 1999 (JP) ..... 11-251607

(51) Int. Cl.[7] ..... G04B 27/02
(52) U.S. Cl. ..... 368/190; 368/74
(58) Field of Search ..... 368/190–200

(56) References Cited

U.S. PATENT DOCUMENTS 4,744,068 A * 5/1988 Nikles et al. ..... 368/190
5,042,016 A * 8/1991 Suzuki et al. ..... 368/74

* cited by examiner

*Primary Examiner*—Bernard Roskoski
(74) *Attorney, Agent, or Firm*—Adams & Wilks

(57) ABSTRACT

A correcting lever is integrally provided with a correcting portion for correcting a fifth wheel, a reset portion brought into contact with a reset pin for stopping an output of a pulse signal from an IC, a return spring portion and an engaged portion and is rotatably supported about a rotary center portion (hole) to a base plate. An engagement portion of a winding stem is engaged with the engaged portion by operation of drawing the winding stem and the correcting lever is shifted against the biasing force by a return spring portion in accordance with the motion of the winding stem so that the correcting portion and the reset portion are forcibly rotated to the fifth wheel and the reset pin, respectively, about the rotary center portion (hole) to thereby perform the correcting and reset actions.

22 Claims, 5 Drawing Sheets

ELECTRONIC WATCH WITH CORRECTING MECHANISM

BACKGROUND OF THE INVENTION

1. Field of the Invention

The present invention relates to an electronic watch with a correcting mechanism for correcting a gear for advancing a hand to stop the hand by drawing a winding stem when setting the watch and so on, and at the same time contacting with a pulse stopping means to stop an output of a pulse signal from a circuit.

2. Description of the Prior Art

For instance, the following type is known as such an electronic watch with a correcting mechanism.

One type is such that a winding stem is operated to be drawn so that a correcting lever and a reset lever are operated through the motion of a member called a mandarin duck and engaged with the winding stem, to thereby perform the correcting and reset actions.

The other type is such that a winding stem is operated to be drawn so that the engagement between the winding stem and a spring is released to release the spring force and the correcting and reset actions are performed by the return force of its spring.

However, in the former type, the mandarin duck is needed between the winding stem and the correcting lever and the reset lever and the correcting lever and the reset lever are to be provided independently of each other, resulting in an increase in number of parts and complication in structure.

Also, in the latter type, since the correcting and reset actions are performed by the return force of the spring, the correcting and reset actions become unstable.

An object of the present invention is to provide an electronic watch with a correcting mechanism in which the number of parts is decreased to simplify the structure and the correcting and reset actions are stabilized.

SUMMARY OF THE INVENTION

In order to attain this object, an electronic watch with a correcting mechanism according to the present invention comprises a correcting lever which stops the hand and which is brought into contact with the pulse stopping means for stopping the output of the pulse signal from the circuit, and the winding stem provided with an engagement portion that may engage with said correcting lever.

The correcting lever is integrally provided with a correcting portion for correcting the gear for advancing the hand, a reset portion brought into contact with the pulse stopping means for stopping the output of the pulse signal from the circuit, a return spring portion for integrally biasing the correcting portion and the reset portion to rotate in a direction away from the gear for advancing the hand and the pulse stopping means, and an engaged portion that may be engaged with the engagement portion provided in said winding stem by the operation of drawing the winding stem, and is rotatably supported about a rotary center portion to a watch body.

Then, in the electronic watch with the correcting mechanism of the present invention, the winding stem is operated to be drawn so that the engagement portion of the winding stem is engaged with the engaged portion and is shifted against the biasing force by the return spring portion in accordance with the motion of the winding stem whereby the correcting portion and the reset portion are forcibly rotated to the gear for advancing the hand and the pulse stopping means about the rotary center portion, respectively.

BRIEF DESICRIPTION OF THE DRAWINGS

A preferred form of the present invention is illustrated in the accompanying drawings in which.

DETAILED DESCRIPTION OF THE PREFERRED EMBODIMENTS

A preferred embodiment of the present invention will now be described with reference to the drawings.

Figure 2:
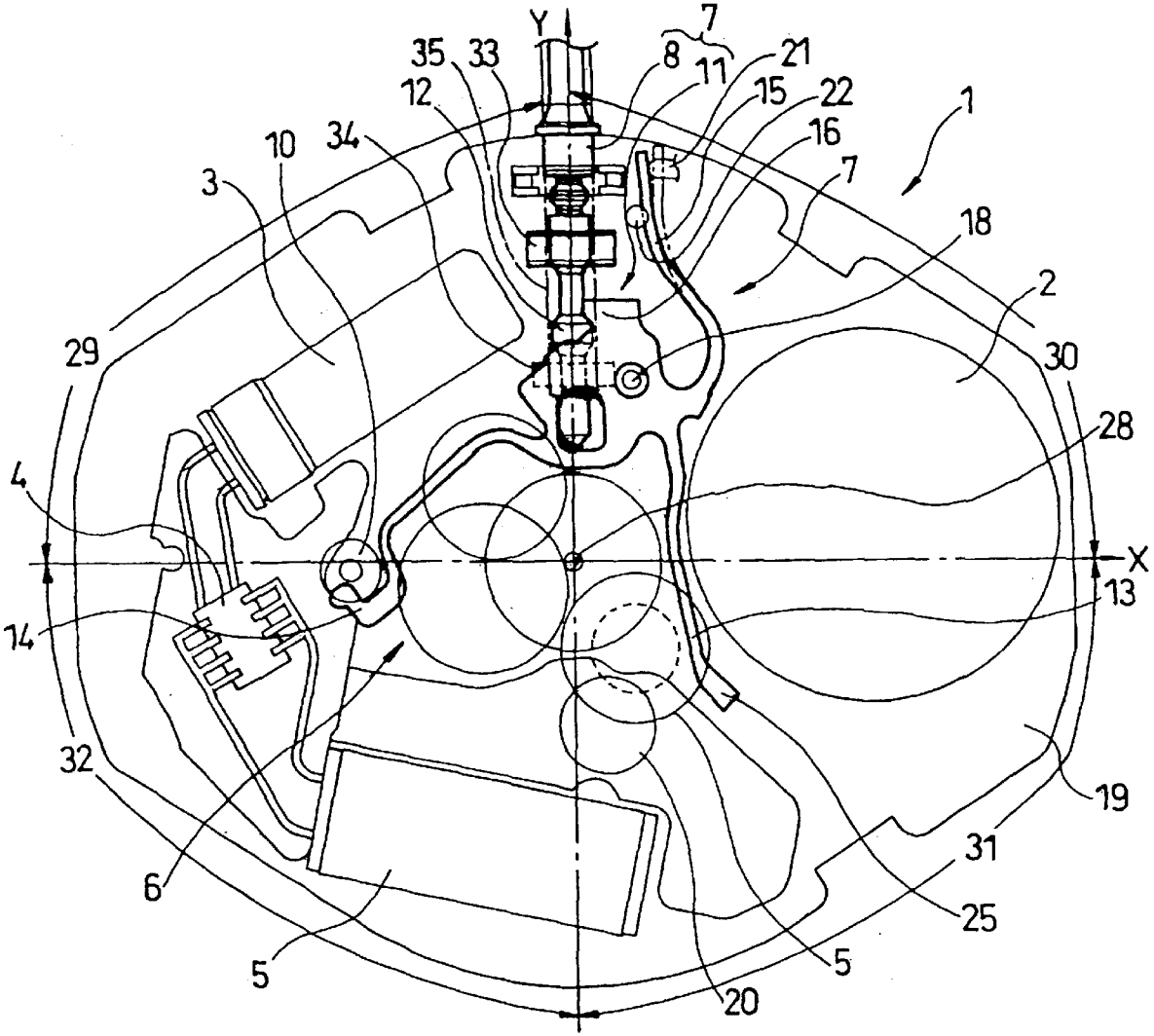
FIG. 2 is a frontal view of an overall structure of the electronic watch with the correcting mechanism of FIG. 1.

FIG. 2 shows one embodiment of an electronic watch with a correcting mechanism according to the present invention.

This electronic watch 1 is provided with a battery 2 that serves as an electric power source, a quartz 3 that oscillates by this battery 2, an IC 4 that is a circuit for frequency dividing and outputting a signal from the quartz 3, a converter 5 converting a pulse signal from this IC 4 into a mechanical rotational force, a gear train 6 for transmitting the rotational force by this converter 5 to hands, and a correcting mechanism 7 for stopping the hands when setting the watch and so on.

Here, the correcting mechanism 7 has a function to correcting the gears for advancing the hands such as a fifth wheel 9 or the like to stop the hands when the winding stem 8 is operated to be drawn by the user when setting the watch and so on, and at the same time to stop the output of the pulse signal from the IC 4 by being brought in contact with the pulse stopping means such as a reset pin 10 or the like.

Figure 1:
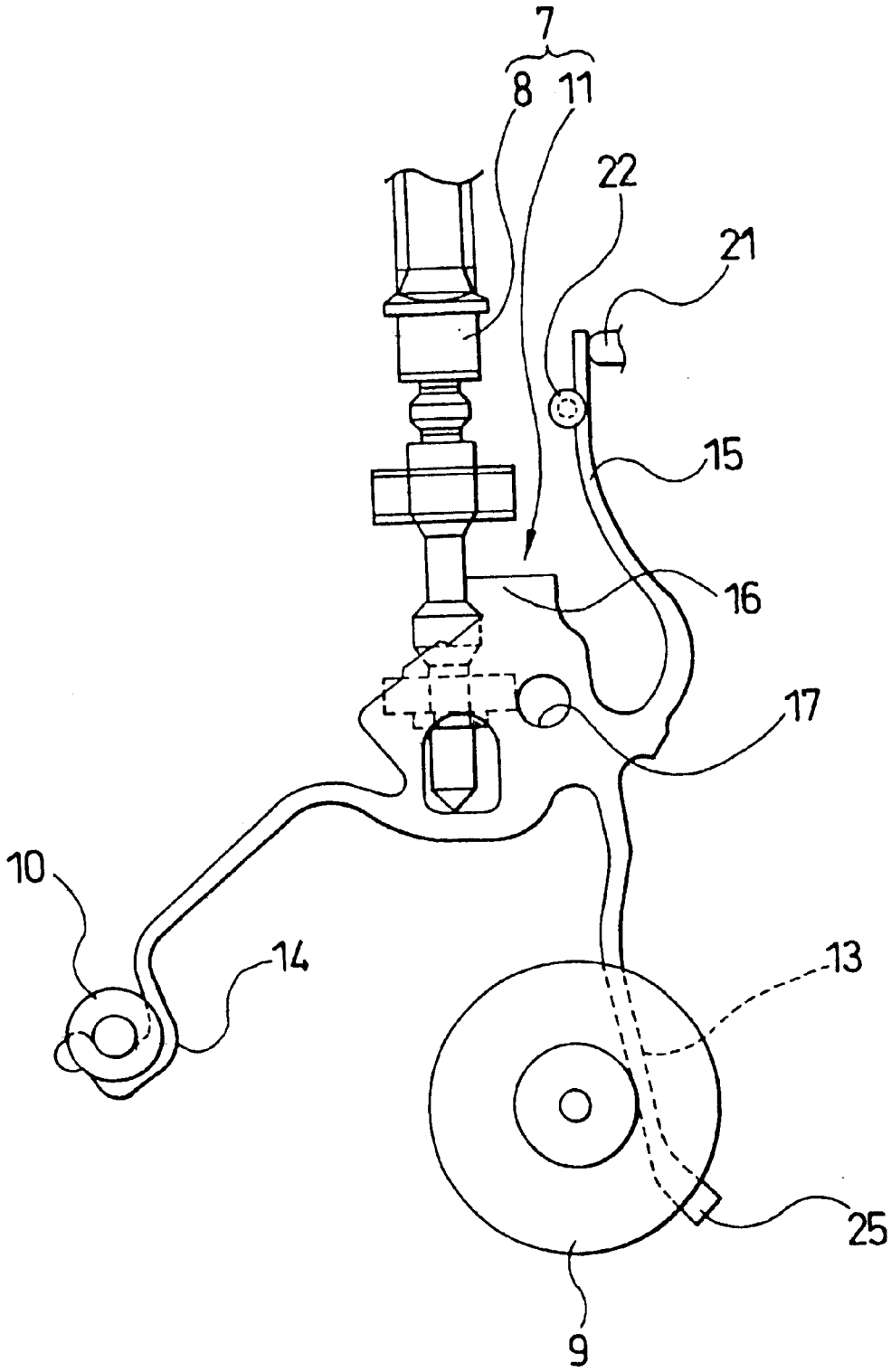
FIG. 1 is a frontal view showing a primary part of one embodiment of an electronic watch with a correcting mechanism according to the present invention.

As shown in FIG. 1 and FIG. 2, the correcting mechanism 7 has a correcting lever 11 for stopping the hands and stopping the output of the pulse signal by being brought in contact with the reset pin 10, and the winding stem 8 provided with an engagement portion 12 that may be engaged with this correcting lever 11.

The correcting lever 11 is integrally provided with a correcting portion 13 for correcting the fifth wheel 9, a reset portion 14 for stopping the output of the pulse signal from the IC 4 in contact with the reset pin 10, a return spring 15 for biasing integrally the correcting portion 13 and the reset portion 14 to rotate in a direction away from the positions of the fifth wheel 9 and the reset pin 10, and an engaged portion 16 that may be engaged with the engagement portion 12 provided in the winding stem 8 by the operation of drawing the winding stem 8, and is rotatably supported about a rotary center portion 18 to a watch body such as a base plate 19 or the like.

The correcting lever 11 is adapted so that the correcting portion 13 and the reset portion 14 are forcibly rotated to the fifth wheel 9 and the reset pin 10 about the rotary center portion 18, respectively, by engaging the engagement portion 12 of the winding stem 8 with the engaged portion 16 and shifting against the biasing force by the return spring portion 15 in accordance with the motion of the winding stem 8 by the operation of drawing the winding stem 8.

The correcting lever 11 is made of a metal plate or the like and the return spring portion 15 is extended in the opposite direction to the extension direction of the correcting portion 13 and the reset portion 14. The correcting portion 13, the reset portion 14 and the return spring portion 15 are spring-like extension parts. The rotary center portion 18 is adapted to be supported to the base plate 19 through a support tool 18 such as a screw pin or pin or the like to a hole 17 provided in the center of rotation of the correcting lever 11. (The support tool and the rotary center portion are designated by the same reference numeral 18.)

The fifth wheel 9 is one of the gears of the gear train 6 and serves to receive the rotational force from a rotor 20 of the converter 5 and to transmit it to the other gears. The reset pin 10 serves to stop the output of the pulse signal from the IC 4 to the converter 5. The terminal portion of the return spring portion 15 is adapted to be retained at a stopper 21 provided on the base plate 19 or the like.

The correcting lever 11 is arranged in the electronic watch 1 as follows. Referring to FIG. 2, a front surface of the electronic watch 1 is divided into four regions by a phantom Y-axis Y that is a straight line extending through a hand supporting portion 28 that becomes the center of rotation of the hands in the longitudinal direction of the winding stem 8 and a phantom X-axis X that is a straight line perpendicular to this phantom Y-axis Y passing through the hand supporting portion 28, assuming that the left upper region be a first region 29, the right upper region be a second region 30, the right lower region be a third region 31 and the left lower region be a fourth region 32 as the electronic watch 1 is viewed from the front side. The quartz 3 is mainly arranged in the first region 29, the battery 2 is mainly arranged in the second region 30, and the gear train 6 is arranged close to the hand supporting portion 28 and located between the quartz 3 and the battery 2. Then, the correcting lever 11 is arranged with its correcting portion 13 sandwiched between the battery 2 and the gear train 6, with the reset portion 14 sandwiched between the quartz 3 and the gear train 6 and with the rotary center portion 18 sandwiched between the winding stem 8 and the battery 3.

Figure 3:
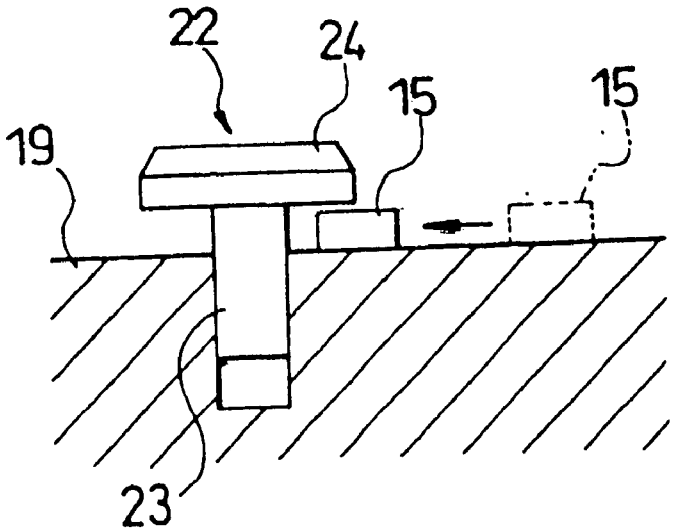
FIG. 3 is an enlarged cross-sectional view illustrating the positional relationship between the swing hook member and the correcting lever.

A swing hook member such as a swing hook pin 22 for preventing the "swing" that is vibration caused by a tilt in the axial direction of the correcting lever 11 is provided to the base plate 19 or the like close to the correcting lever 11. This swing hook pin 22 has a pivot portion 23 fixed to and fit in the base plate 19 or the like and a jaw portion 24 for regulating the upper surface in the vicinity of the end portion of the return spring portion 15 of the correcting lever 11 and provided on this pivot portion 23. As shown in FIG. 3, the return spring portion 15 of the correcting lever 11 is located in a position away from the swing hook pin 22 before it is retained by the stopper 21 but is adapted to be inserted between the jaw portion 24 of the swing hook pin 22 and the base plate 19 when it is retained by the stopper 21.

Figure 4:
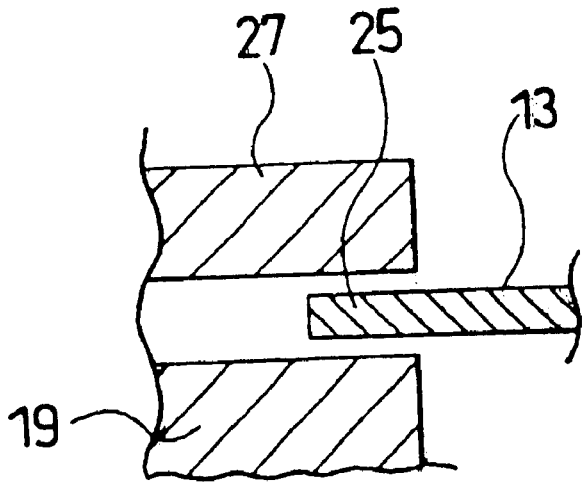
FIG. 4 is an enlarged cross-sectional view showing the relationship between the axial motion determining portion of the correcting lever and the axial motion determining member.

An axial motion determining portion 25 for determining an amount of an axial motion of the correcting lever 11 in the axial direction is provided to extend from a tip end portion of the correcting portion 13 in the correcting lever 11. Then, as shown in FIG. 4, a gear train receiver 27 forming a gap 26 into which the axial motion determining portion 25 is inserted and the axial motion determining member such as the base plate 19 are provided. The axial motion of the correcting lever 11 is determined in accordance with the axial motion determining portion 25 (the tip end portion of the correcting lever 11) that has been inserted in the gap 26 between the gear train receiver 27 and the base plate 19.

As shown in FIGS. 1 and 2, the engagement portion 12 is provided to project like a disc on the outer circumference of the winding stem 8.

Also, the winding stem 8 is supported so as to be slid and guided in the axial direction of the winding stem 8 at two positions away from each other at an interval in the longitudinal direction of the winding stem 8 by a plurality (two or the like) of hole-like guide portions 33 and 34 provided away from each other at an interval in the base plate 19 or the like.

The engagement portion 12 of the winding stem 8 is adapted to be located between these two guide portions 33 and 34. Also, the engagement portion 10 of the winding stem 8 is adapted to be slid and guided by a cylindrical guide surface 35 provided in the base plate 19 or the like.

Figure 5:
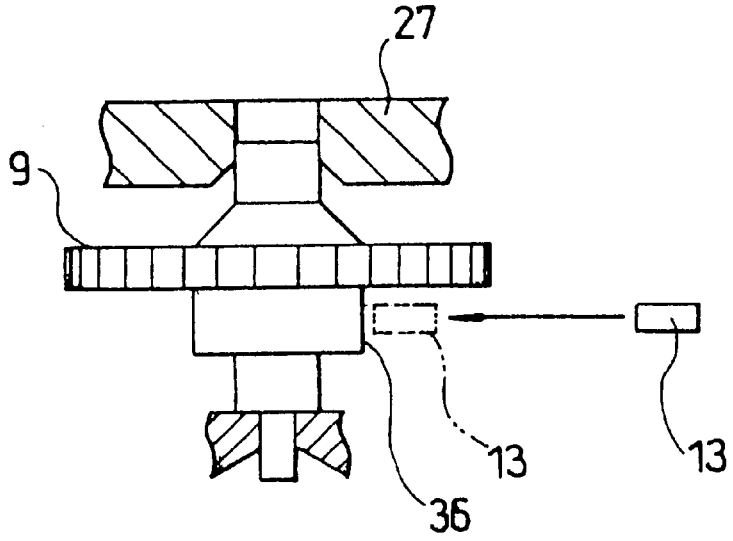
FIG. 5 is a side elevational view showing the correcting surface of the gears for driving the hands and the correcting lever.

As shown in FIG. 5, a cylindrical outer circumferential surface provided in the lower side in the axial direction of the fifth wheel 9 is formed into a correcting surface 36 that is corrected by the correcting portion 13 of the correcting lever 11.

In the thus constructed electronic watch 1 with the correcting mechanism 5, the following correcting action and the reset action are performed.

When the user operates to draw the winding stem 8 to the outside, the engagement portion 12 provided in the winding stem 8 is engaged with the engaged portion 16 of the correcting lever 11, and the correcting lever 11 is shifted against the biasing force by the return spring 15 in accordance with the motion of the winding stem 8 so that the correcting portion 13 and the reset portion 14 are forcibly rotated to the fifth wheel 9 and the reset pin 10, respectively.

When the correcting portion 13 of the correcting lever 11 is brought into pressing contact with the correcting surface 36 located on the lower side of the fifth wheel 9 to correct and stop the fifth wheel 9, the transmission of the rotational force from the rotor 20 of the converter 5 to the gear train 6 is interrupted to stop the motion of the hands. Also, when the reset portion 14 of the correcting lever 11 is brought into contact with the reset pin 10 to stop the output of the pulse signal from the IC 4, the output of the pulse signal from the IC 4 to the converter 5 is stopped to stop the rotor 20 of the converter 5. Subsequently, the user operates to turn the winding stem 8 to set the watch or the like.

After the completion of setting the watch or the like, when the user returns the winding stem 8 back to the original position, the engagement of the engagement portion 12 of the winding stem 8 and the engaged portion 16 of the correcting lever 11 is released, and the return spring portion 15 of the correcting lever 11 rotates the correcting portion 13 and the reset portion 14 in a direction away from the fifth wheel 9 and the reset pin 10 to obtain the original position.

Incidentally, the present invention is not limited to the above-described embodiment but various modifications are possible as follows.

In the above-described embodiment, the axial motion determining portion 25 is provided only in the correcting portion 13 of the correcting lever 11 but is not provided in the reset portion 14. However, it is possible to provide it on both of the correcting portion 13 and the reset portion 14 or to provide it only in the reset portion 14. Also, in the foregoing embodiment, the correcting surface 36 is provided on the lower side of the fifth wheel 9 or the like but it is possible to provide the correcting surface on the upper side.

As described above, the electronic watch with the correcting mechanism according to the present invention ensures the following effects.

(1) According to claim 1 of the present invention, since the correcting lever is formed integrally by the correcting portion, the reset portion, the return spring portion and the engaged portion, it is possible to reduce the number of the parts to thereby simplify the structure, and also, since it is forcibly operated by the winding stem, it is possible to stabilize the correcting action and the reset action.

(2) According to claim 2 of the present invention, since the correcting mechanism is arranged to be passed between the other components, it is possible to thin the electronic watch in comparison with the conventional case where the correcting mechanism is arranged to overlap with the gear train or the like.

(3) According to claim 3 of the present invention, since the swing motion of the correcting lever is prevented by correcting the return spring portion of the correcting lever by the swing hook member, it is possible to stabilize the operation of the correcting lever and to further stabilize the correcting action and the reset action.

(4) According to claim 4 of the present invention, since the axial motion is determined by the center of rotation of the correcting lever and the tip end portion thereof, it is possible to stabilize the rotational motion of the correcting lever to thereby further stabilize the correcting action and the reset action.

(5) According to claim 5 of the present invention, since the correcting portion of the correcting lever corrects the correcting surface that is located at a position offset from the gear surface of the gears for advancing the hands, there is no fear that the gears are damaged. In particular, in the case where the gears are made of resin, the meaning of the prevention of the damage becomes important. Also, even if the correcting force is enhanced, there is no fear that the gears are damaged. Accordingly, it is possible to eliminate the limit to the correcting force as much as possible.

(6) According to claim 6 of the present invention, since the engagement portion of the winding stem is located between the plurality of guide portions for guiding the winding stem, it is possible to eliminate the displacement of the engagement portion as much as possible in comparison with the conventional case where the engagement portion is provided at the tip end of the winding stem, to thereby suppress the variation width upon the operation of the correcting lever as much as possible and to thereby further stabilize the correcting action and the reset action.

(7) According to claim 7 of the present invention, since the engagement portion of the winding stem per se is adapted to be guided, it is possible to reduce the displacement of the engagement portion as much as possible, to thereby make it possible to reduce the variation width upon the operation of the correcting lever as much as possible and to thereby further stabilize the correcting action and the reset action.

What is claimed is:

1. An electronic watch with a correcting mechanism in which a winding stem is operated to be drawn to correct a gear for advancing a hand and to stop the hand, and is brought into contact with a pulse stopping means to stop an output of a pulse signal from a circuit, characterized in that:

said electronic watch comprises a correcting lever which stops the hand and which is brought into contact with the pulse stopping means to stop the output of the pulse signal from the circuit, and the winding stem provided with an engagement portion that may engage with said correcting lever;

that said correcting lever is integrally provided with a correcting portion for correcting the gear for advancing the hand, a reset portion brought into contact with said pulse stopping means for stopping the output of the pulse signal from the circuit, a return spring portion for integrally biasing said correcting portion and said reset portion to rotate in a direction away from the positions of the gear for advancing the hand and the pulse stopping means, and an engaged portion that may be engaged with the engagement portion provided in said winding stem by the operation of drawing said winding stem, and is rotatably supported about a rotary center portion to a watch body; and that said winding stem is operated to be drawn so that the engagement portion of said winding stem is engaged with the engaged portion and is shifted against the biasing force by said return spring portion in accordance with the motion of said winding stem whereby said correcting portion and said reset portion are forcibly rotated to the gear for advancing the hand and the pulse stopping means about said rotary center portion, respectively.

2. The electronic watch with the correcting mechanism according to claim 1, characterized in that, upon arranging the correcting lever of the correcting mechanism as described in claim 1 in the electronic watch provided with the winding stem, a battery, a quartz and a gear train, assuming that a straight line extending passing through a hand supporting portion that becomes a center of rotation of the hand in a longitudinal direction of said winding stem be a phantom Y-axis and a straight line perpendicular to said phantom Y-axis while passing through said hand supporting portion be a phantom X-axis, a front surface of said electronic watch is divided into four regions by said Y-axis and X-axis, and assuming that a left upper region of the front surface of said electronic watch be a first region, a right upper region be a second region, a right lower region be a third region and a left lower region be a fourth region, said quartz is mainly arranged in said first region, said battery is mainly arranged in said second region, said gear train is arranged close to said hand supporting portion and between said quartz and said battery, and that said correcting lever is arranged with its correcting portion between said battery and said gear train, with said reset portion between said quartz and said gear train and with said rotary center portion between said winding stem and said battery.

3. The electronic watch with the correcting mechanism according to claim 1, characterized in that a swing hook member for correcting an upper surface of the return spring portion of said correcting lever and for preventing a swing that is vibration caused by a tilt in the axial direction of said correcting lever is provided on a watch body.

4. The electronic watch with the correcting mechanism according to claim 2, characterized in that a swing hook member for correcting an upper surface of the return spring portion of said correcting lever and for preventing a swing that is vibration caused by a tilt in the axial direction of said correcting lever is provided on a watch body.

5. The electronic watch with the correcting mechanism according to any one of claim 1, characterized in that an axial motion determining portion is provided to extend from a tip end portion of at least one of the correcting portion and/or the reset portion of said correcting lever for serving to determine an axial motion that is an amount of the possible movement of said correcting lever in the axial direction, and that an axial motion determining member in which a gap through which said axial motion determining portion of said correcting portion and reset portion is passed is provided.

6. The electronic watch with the correcting mechanism according to any one of claim 2, characterized in that an axial motion determining portion is provided to extend from a tip end portion of at least one of the correcting portion and/or the reset portion of said correcting lever for serving to determine an axial motion that is an amount of the possible movement of said correcting lever in the axial direction, and that an axial motion determining member in which a gap through which said axial motion determining portion of said correcting portion and reset portion is passed is provided.

7. The electronic watch with the correcting mechanism according to any one of claim 3, characterized in that an axial motion determining portion is provided to extend from a tip end portion of at least one of the correcting portion and/or the reset portion of said correcting lever for serving to determine an axial motion that is an amount of the possible movement of said correcting lever in the axial direction, and that an axial motion determining member in which a gap through which said axial motion determining portion of said correcting portion and reset portion is passed is provided.

8. The electronic watch with the correcting mechanism according to any one of claim 1, wherein the gear for advancing the hand to be corrected by the correcting portion of said correcting lever is formed into a correcting surface having a cylindrical outer circumferential surface formed on an upper side or a lower side in its axial direction to be corrected said correcting portion.

9. The electronic watch with the correcting mechanism according to any one of claim 2, wherein the gear for advancing the hand to be corrected by the correcting portion of said correcting lever is formed into a correcting surface having a cylindrical outer circumferential surface formed on an upper side or a lower side in its axial direction to be corrected said correcting portion.

10. The electronic watch with the correcting mechanism according to any one of claim 3, wherein the gear for advancing the hand to be corrected by the correcting portion of said correcting lever is formed into a correcting surface having a cylindrical outer circumferential surface formed on an upper side or a lower side in its axial direction to be corrected said correcting portion.

11. The electronic watch with the correcting mechanism according to any one of claim 4, wherein the gear for advancing the hand to be corrected by the correcting portion of said correcting lever is formed into a correcting surface having a cylindrical outer circumferential surface formed on an upper side or a lower side in its axial direction to be corrected said correcting portion.

12. The electronic watch with the correcting mechanism according to any one of claim 1, characterized in that said winding stem is supported so as to be slid and guided at a plurality of positions away from each other at an interval in the longitudinal direction of said winding stem by a plurality of hole-like guide portions away from each other at an interval in the watch body, and that said engagement portion is adapted to be located between said plurality of guide portions.

13. The electronic watch with the correcting mechanism according to any one of claim 2, characterized in that said winding stem is supported so as to be slid and guided at a plurality of positions away from each other at an interval in the longitudinal direction of said winding stem by a plurality of hole-like guide portions away from each other at an interval in the watch body, and that said engagement portion is adapted to be located between said plurality of guide portions.

14. The electronic watch with the correcting mechanism according to any one of claim 3, characterized in that said winding stem is supported so as to be slid and guided at a plurality of positions away from each other at an interval in the longitudinal direction of said winding stem by a plurality of hole-like guide portions away from each other at an interval in the watch body, and that said engagement portion is adapted to be located between said plurality of guide portions.

15. The electronic watch with the correcting mechanism according to any one of claim 4, characterized in that said winding stem is supported so as to be slid and guided at a plurality of positions away from each other at an interval in the longitudinal direction of said winding stem by a plurality of hole-like guide portions away from each other at an interval in the watch body, and that said engagement portion is adapted to be located between said plurality of guide portions.

16. The electronic watch with the correcting mechanism according to any one of claim 5, characterized in that said winding stem is supported so as to be slid and guided at a plurality of positions away from each other at an interval in the longitudinal direction of said winding stem by a plurality of hole-like guide portions away from each other at an interval in the watch body, and that said engagement portion is adapted to be located between said plurality of guide portions.

17. The electronic watch with the correcting mechanism according to any one of claim 1, characterized in that said engagement portion of said winding stem is adapted to be slid and guided along said hole-like guide surface provided in the watch body.

18. The electronic watch with the correcting mechanism according to any one of claim 2, characterized in that said engagement portion of said winding stem is adapted to be slid and guided along said hole-like guide surface provided in the watch body.

19. The electronic watch with the correcting mechanism according to any one of claim 3, characterized in that said engagement portion of said winding stem is adapted to be slid and guided along said hole-like guide surface provided in the watch body.

20. The electronic watch with the correcting mechanism according to any one of claim 4, characterized in that said engagement portion of said winding stem is adapted to be slid and guided along said hole-like guide surface provided in the watch body.

21. The electronic watch with the correcting mechanism according to any one of claim 5, characterized in that said engagement portion of said winding stem is adapted to be slid and guided along said hole-like guide surface provided in the watch body.

22. The electronic watch with the correcting mechanism according to any one of claim 6, characterized in that said engagement portion of said winding stem is adapted to be slid and guided along said hole-like guide surface provided in the watch body.

* * * * *